US006067976A

United States Patent [19]

Katayama et al.

[11] Patent Number: 6,067,976

[45] **Date of Patent: *May 30, 2000**

[54] WAFER CUT METHOD WITH WIRE SAW APPARATUS AND APPARATUS THEREOF

[75] Inventors: Ichiro Katayama; Shinji Shibaoka; Shozo Katamachi, all of Mitaka, Japan

[73] Assignee: Tokyo Seimitsu Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/854,701

[22] Filed: May 12, 1997

Related U.S. Application Data

[63] Continuation-in-part of application No. 08/364,299, Dec. 27, 1994, abandoned.

[30] Foreign Application Priority Data

Jan. 10, 1994 [JP] Japan ..... 6-000733

[51] Int. Cl.[7] ..... B28D 1/08

[52] U.S. Cl. ..... 125/21; 125/16.02

[58] Field of Search ..... 125/13.01, 12, 125/21, 16.04, 16.02; 83/651.1; 451/168, 60, 446, 296

[56] References Cited

U.S. PATENT DOCUMENTS

| | | | |
|---|---|---|---|
| 2,866,448 | 12/1958 | Dessureau et al. | 125/21 |
| 3,220,149 | 11/1965 | Dioguardi | 125/21 |
| 3,400,494 | 9/1968 | Seitz | 125/21 |
| 4,160,439 | 7/1979 | Plat | 125/21 |
| 4,484,502 | 11/1984 | Ebner | 125/12 |
| 4,574,769 | 3/1986 | Ishikawa | 125/21 |
| 4,967,725 | 11/1990 | Hinzen | 125/21 |
| 5,269,285 | 12/1993 | Toyama et al. | 125/16.02 |

FOREIGN PATENT DOCUMENTS

| | | | |
|---|---|---|---|
| 10115 | 5/1909 | France | 125/21 |
| 1138353 | 10/1962 | Germany | 125/21 |
| A-61-164776 | 7/1986 | Japan . | |
| A-1-316162 | 12/1989 | Japan . | |
| 2-152764 | 6/1990 | Japan . | |
| 3-208555 | 9/1991 | Japan . | |
| 5245825 | 9/1993 | Japan | 125/21 |

*Primary Examiner*—Robert A. Rose
*Attorney, Agent, or Firm*—Oliff & Berridge, PLC

[57] ABSTRACT

The moving direction of the wire line 15A at the cut portion 44 for cutting the columnar semiconductor ingot 18 corresponds to the vertical-downward direction. And, the semiconductor ingot 18 supported with the cut-feed means 20 is fed horizontally so as to be pushed in perpendicular to said wire line 15A, and the processing liquid 42 is supplied to the wire line 15A from the grind liquid supply nozzle 40 placed at the upper side of the cut portion 44. Therefore, the processing liquid 42 supplied to the wire line 15A flows along the wire line 15A, so that the processing liquid 42 can be surely supplied to the cut portion 44.

5 Claims, 8 Drawing Sheets

WAFER CUT METHOD WITH WIRE SAW APPARATUS AND APPARATUS THEREOF

BACKGROUND OF THE INVENTION

This application is a Continuation-in-Part of U.S. patent application Ser. No. 08/364,299, filed Dec. 27, 1994, now abandoned.

1. FIELD OF INVENTION

The present invention relates to a wafer cut method with a wire saw apparatus and an apparatus thereof, more particularly to a wafer cut method with a wire saw apparatus and an apparatus thereof wherein a columnar semiconductor ingot is cut into many thin wafers with a wire line which moves at a high speed.

2. DESCRIPTION OF RELATED ART

In the conventional wafer cut method with the wire saw apparatus, a columnar semiconductor ingot supported with a cut-feed means is pushed to a wire line from the top or the bottom perpendicular to the wire line which has wound round rollers with a plurality of grooves which move in the horizontal direction at a high speed, and processing liquid including grind grains is supplied to the wire line which moves in the horizontal direction from the grind liquid supply nozzle placed at the upper side of the wire line. With this arrangement, the semiconductor ingot is cut into a lot of thin wafers by the lapping of the grind grains included in the processing liquid, which is supplied to the wire line.

However, in the conventional wafer cut method with wire saw apparatus, the moving direction of the wire saw apparatus is horizontal, therefore, there is a problem in that the processing liquid supplied to the wire line is hard to be supplied to the cut portion of the semiconductor Ingot. That is, when the processing liquid is supplied to the wire line from the upper side, most of the processing liquid which adheres to the wire line falls by gravity before achieving the cut portion. As the result, there is not enough processing liquid supplied to the cut portion, so that the cut performance and the cut accuracy is lowered. Therefore, there are problems in that the cut performance lowers whereby the cut time becomes longer and the flatness of the wafer which has been cut, that is, the profile regularity is lowered.

SUMMARY OF THE INVENTION

The present invention has been developed to eliminate the above-described problems and has as its aim the provision of a wafer cut method with a wire saw apparatus and an apparatus thereof in which the processing liquid is supplied easily to the cut portion, so that the cut performance and the cut accuracy can be improved.

To achieve the above-described object, a wafer cut method with a wire saw apparatus in which a longitudinal direction of a workpiece is pushed perpendicular to a wire line which moves and said workpiece is cut into a lot of thin wafers while supplying processing liquid which includes grind grains to said wire line, comprising of: setting a moving direction of said wire line at a cut portion of said workpiece to a vertical-downward direction; and, supplying said processing liquid to said wire line from an upper side of said cut portion.

According to this invention, the moving direction of the wire line at the cut portion of the workpiece is set to the vertical-downward direction and the workpiece is pushed perpendicular to the wire line by the ingot feed means and the processing liquid including grind grains is supplied to the wire line from the grind liquid supply means placed at the upper side of said cut portion.

As described above, the moving direction of the wire line at the cut portion of the workpiece is set to the vertical-downward direction to correspond to the gravity direction and the processing liquid is supplied to the wire line from the upper side of the cut portion, therefore, the processing liquid supplied to the wire line falls along the wire line so as to be surely supplied to the cut portion.

BRIEF DESCRIPTION OF THE DRAWINGS

The exact nature of this invention, as well as other aims and advantages thereof, will be readily apparent from consideration of the following specification relating to the accompanied drawings, in which like reference characters designate the same or similar parts throughout the figures thereof and wherein.

DETAILED DESCRIPTION OF PREFERRED EMBODIMENTS

A detailed description will hereafter be given of the preferred embodiment of a wafer cut method with a wire saw apparatus and an apparatus thereof according to the present invention with reference to the accompanying drawings.

Figure 1:
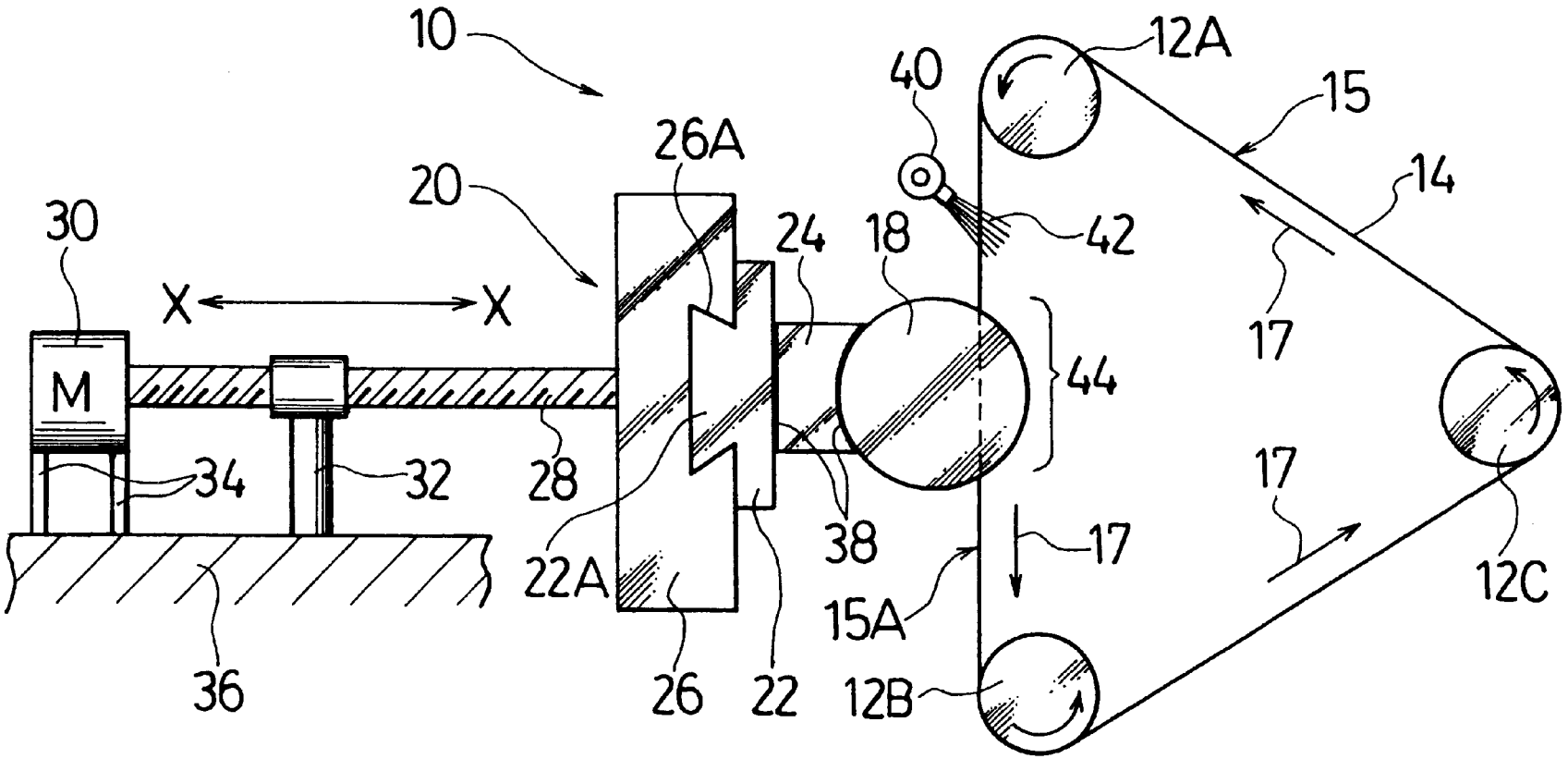
FIG. 1 is a view explaining the first embodiment of a wire saw apparatus according to the present invention.
Figure 2:
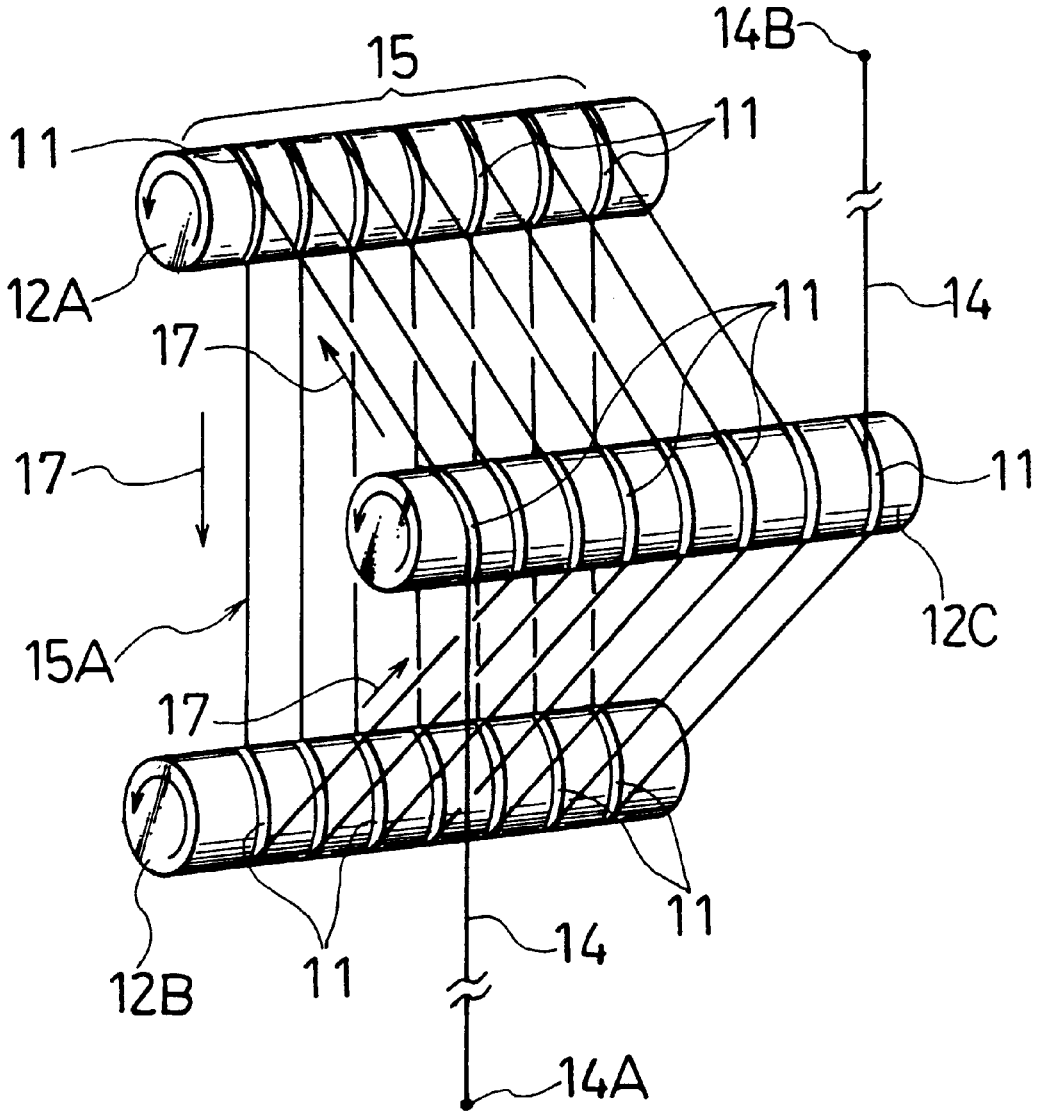
FIG. 2 is a perspective view for explaining a wire line of the wire saw apparatus according to the present invention.

FIG. 1 is a view explaining the first embodiment of a wire saw apparatus 10 according to the present invention. And, FIG. 2 is a perspective view for explaining a wire line of a wire saw apparatus. As shown in FIGS. 1 and 2, three rollers 12A, 12B, 12C, which have a plurality of grooves 11, 11 . . . by predetermined pitches on the peripheral surfaces, are placed to form a substantial triangle, and a wire 14 is wound round the grooves 11 of the three rollers 12A, 12B, 12C in sequence at a predetermined tension to form a wire line 15. One end 14A of the wire 14 is connected with a supply reel, not shown, and the other end 14B is connected with a wind reel. The wire 14, which is supplied from the supply reel, is wound round the wind reel, not shown, while moving in the direction of the arrow 17 along the wire line 15 in FIGS. 1 and 2 at a high speed (more than 600 m/minute). With this arrangement, the wire line 15 moves downward between the roller 12A with grooves and the roller 12B with grooves. Hereafter, the wire line 15 between the roller 12A with grooves and the roller 12B with grooves is called wire line 15A.

As shown in FIG. 1, a cut-feed means 20 for feeding a workpiece, that is, the columnar semiconductor ingot 18 is placed at the left position of the rollers 12A, 12B with grooves. The cut-feed means 20 comprises mainly of a workpiece feed table 26 for supporting the semiconductor ingot 18 through a workpiece block 22 and a slice base 24, a ball screw 28 for moving the workpiece feed table 26 in the X—X direction of FIG. 1 and a motor 30 for rotating the ball screw 28 clockwise and counterclockwise. The ball screw 28 and the motor 30 are mounted on a base 36 through respective support members 32, 34, and the workpiece feed table 26 does not rotate even if the ball screw 28 rotates. The slice base 24 adheres to the semiconductor ingot 18 and to the workpiece block 22 with adhesives 38. A dovetail groove 26A formed on the workpiece feeding table 26 is engaged with a project portion 22A of the workpiece block 22, which is formed to engage with the dovetail groove 26A, whereby the workpiece block 22 is fixed to the workpiece feed table 26. Thus, when the motor 30 rotates clockwise, the workpiece feed table 26 is moved to the wire line 15A with the ball screw 28, whereby the semiconductor ingot 18 is pushed against the wire line 15A. When the motor 30 rotates counterclockwise, the workpiece feed table 26 is moved in the opposite direction of the wire line 15A with the ball screw 28, whereby the workpiece feeding table 26 is put back.

A grind liquid supply nozzle 40 is placed at the upper side of the semiconductor ingot 18 which is pushed against the wire line 15A to be cut, and the processing liquid 42 including grind grains (usually, grind grains of which a grain size is about #600-#100 are used) is supplied to the wire line 15A which moves downward. Thus, the semiconductor ingot 18, which is pushed against the wire line 15A, is cut into a lot of thin wafers by the lapping of the grind grains in the processing liquid 42.

Next, a description will be given of the wafer cut method with a wire saw apparatus according to the present invention with the wire saw apparatus 10 as described above.

The motor 30 of the cut-feed means 20 is rotated clockwise to feed the workpiece feeding table 26 to the wire line 15A, and the longitudinal direction of the semiconductor ingot 18 is pushed against the wire line 15A vertically. Further, the processing liquid 42 is supplied to the wire line 15A from the grind liquid supply nozzle 40 which is placed at the upper side of the cut portion 44 of the semiconductor ingot 18. Thus, the processing liquid 42 supplied to the wire line 15A flows along the wire line 15A, so that the processing liquid 42 can be surely supplied to the cut portion 44 of the semiconductor ingot 18.

As described above, according to the wafer cut method with a wire saw apparatus and the apparatus thereof in the present invention, the moving direction of the cut portion 44 of the semiconductor ingot 18 is set to the vertical-downward direction to correspond to the gravity direction, and the processing liquid 42 is supplied to the wire line 15A from the upper side of the cut portion 44, therefore, the processing liquid 42 supplied to the wire line 15A flows along the wire line 15A, so that the processing liquid 42 can be supplied smoothly and surely. With this arrangement, the lapping is performed effectively with the grind grains in the processing liquid 42, so that the cut performance can be improved. Therefore, the cut-feed speed of the semiconductor ingot 18 can be increased, so that the cut time can be reduced. Further, the processing liquid is supplied to over all the cut portion 44 of the semiconductor ingot 18 evenly, so that the cut accuracy can be improved. Therefore, the flatness of the cut surface of the semiconductor ingot 18 which has been cut becomes better, so that the quality of the wafer can be improved.

Figure 3:
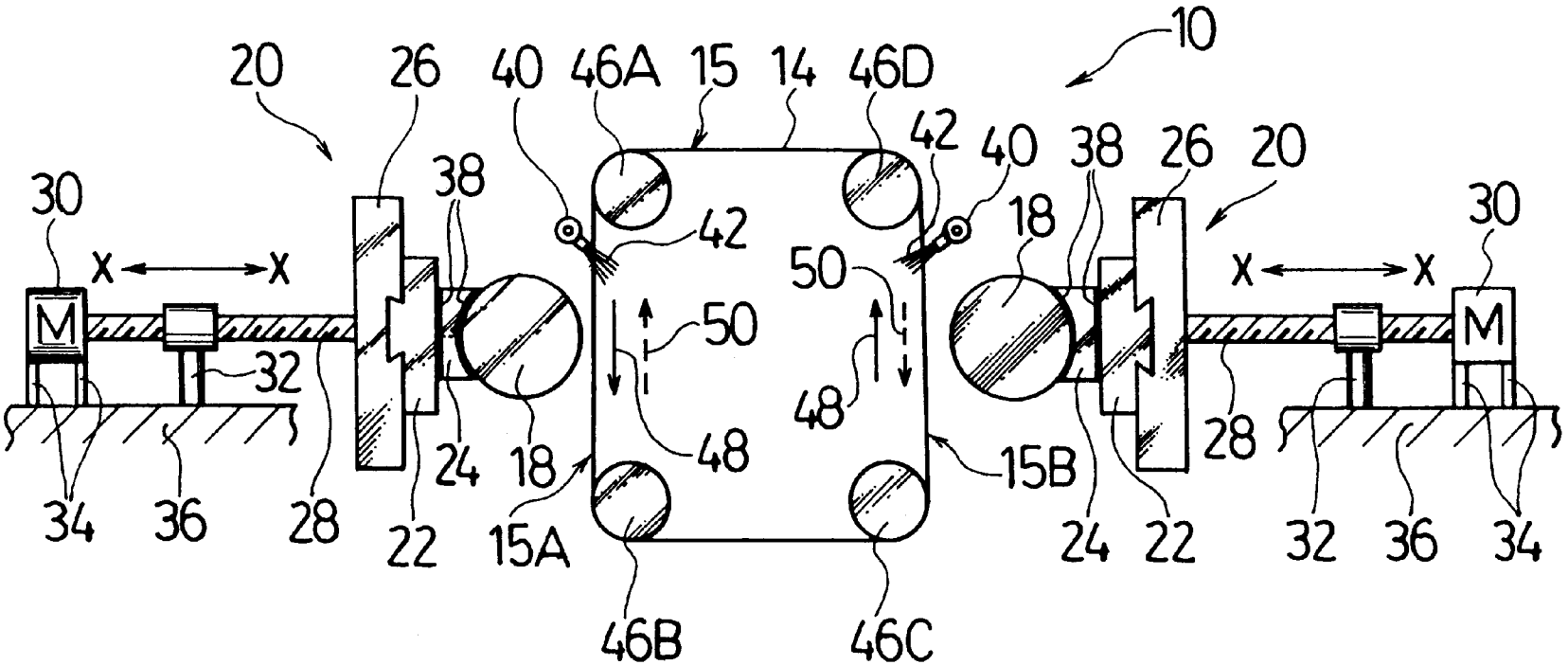
FIG. 3 is a view explaining the second embodiment of a wire saw apparatus according to the present invention.

Next, an explanation will be given of the second embodiment of the wafer cut method with a wire saw apparatus and an apparatus thereof according to the present invention. FIG. 3 is a view for explaining the second embodiment of the wire saw apparatus 10 according to the present invention. In the second embodiment, the same members are designated to the same numeral number in the first embodiment.

The difference between the first and second embodiments is that four rollers 46A, 46B, 46C, 46D with grooves are arranged so as to form a square and the wire 14 is wound round them to form the wire line 1,5 which moves in the vertical-downward direction by reciprocating the wire 14. That is, the wire line 15 of the wire 14 supplied from a supply reel, not shown, moves in the direction of the solid-line arrow 48 in FIG. 3 and is wound round a wind reel, not shown. Thus, the wire line 15A at the left side in FIG. 3 can be moved in the vertical-downward direction. Further, the wire 14, which is wound round the wind reel, is rewound and wound round the supply reel, whereby the wire of the wire line 15 is moved in the broken-line arrow 50 in FIG. 3. Thus, the wire line 15B at the right side In FIG. 3 can be moved in the vertical-downward direction. At the same positions with the first embodiment, two cut-feed means 20, 20 and two grind liquid supply nozzles 40, 40 are placed respectively to correspond with the wire lines 15A, 15B, and the semiconductor ingots 18 supported with the respective cut-feed means 20 are cut in sequence according to the reciprocation of the wire 14. That is, when the wire line 15 is moved in the solid-line arrow 48, the semiconductor ingot 18 is cut with the cut-feed means 20 and the grind liquid supply nozzle 40 at the left side in FIG. 3, and when the wire line 15 is moved in the broken-line arrow 50, the semiconductor ingot 18 is cut with the cut-feed means 20 and the grind liquid supply nozzle 40 at the right side in FIG. 3.

With this arrangement, the same effect in the first embodiment can be achieved, and the semiconductor ingots 18 can be cut by the reciprocation of the wire 14. Therefore, the semiconductor ingots 18 can be cut effectively.

Figure 4:
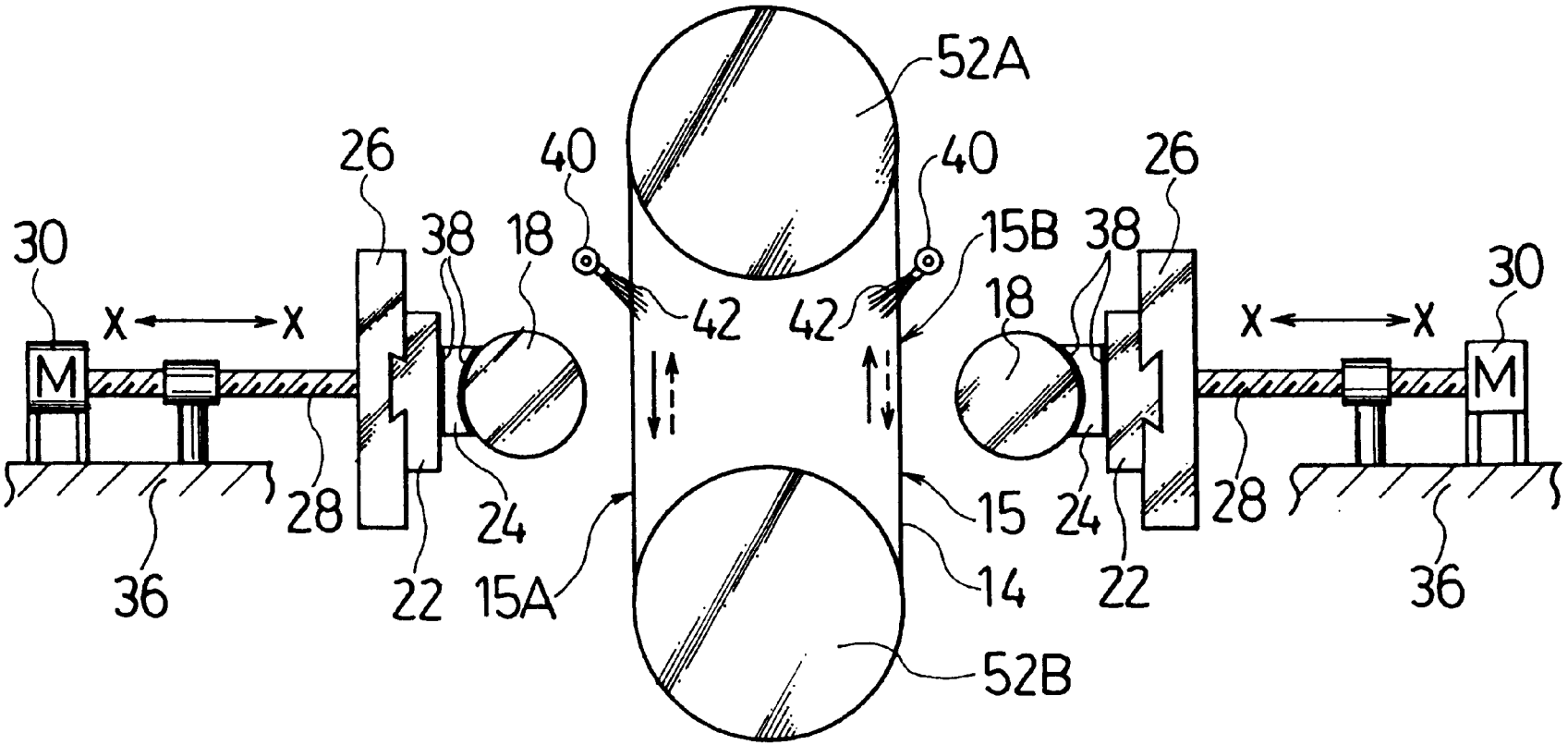
FIG. 4 is a view explaining the third embodiment of a wire saw apparatus according to the present invention.

Next, an explanation will be given of the third embodiment of the wire saw apparatus 10 according to the present invention. As shown in FIG. 4, the difference between the third embodiment and another embodiment is that two rollers 52A, 52B with grooves are placed at the upper and lower sides and the wire 14 is wound round them to form the wire lines 15A, 15B at the right and left sides, which can move in the vertical-downward direction by the reciprocation of the wire 14. In the third embodiment, external diameters of the rollers 52A, 25B with grooves are larger than that of the semiconductor ingot 18. In this case, the same effect of the second embodiment can be achieved.

Figure 5:
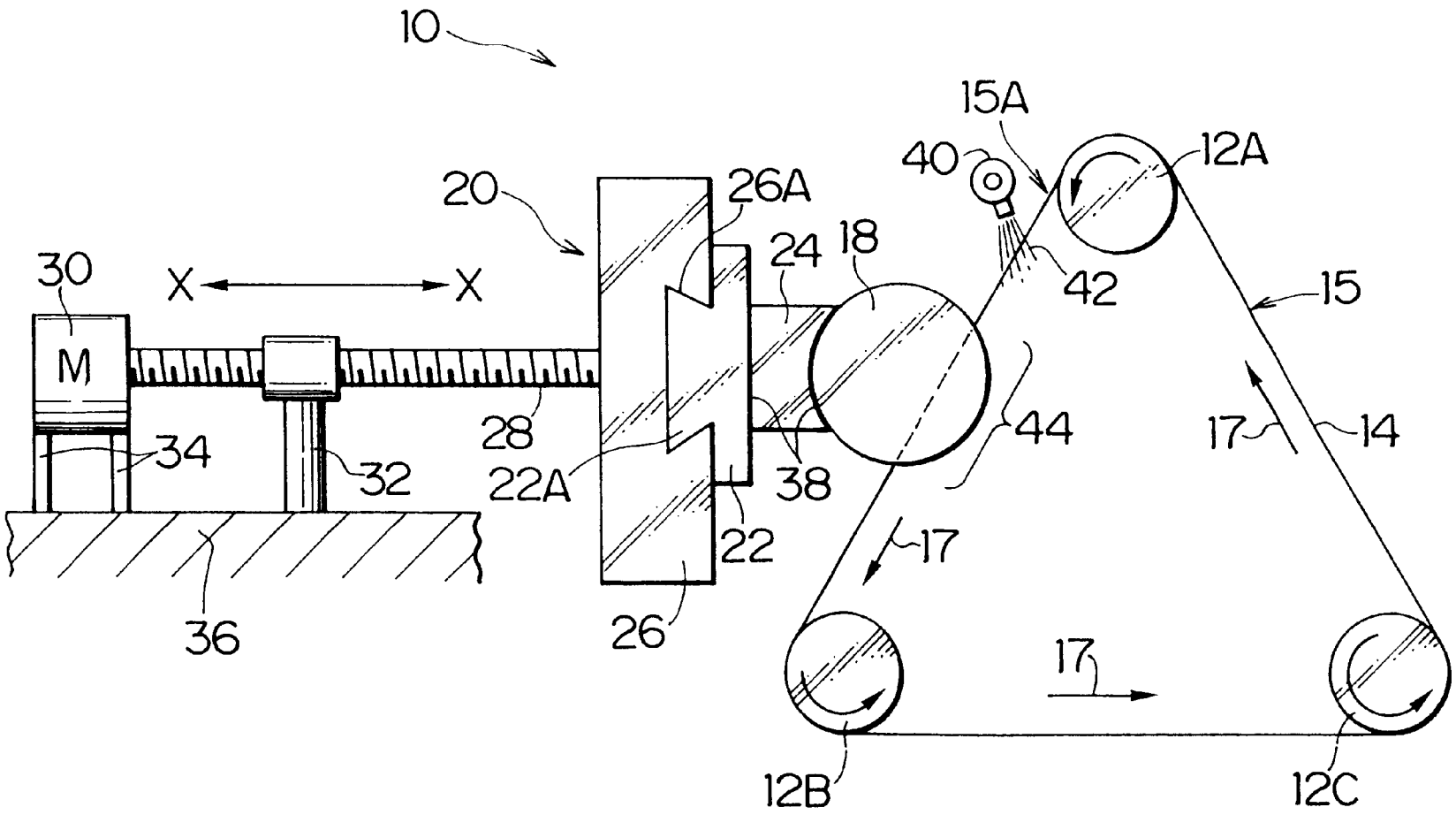
FIG. 5 is a view explaining a fourth embodiment of a wire saw apparatus according to the present invention.
Figure 6:
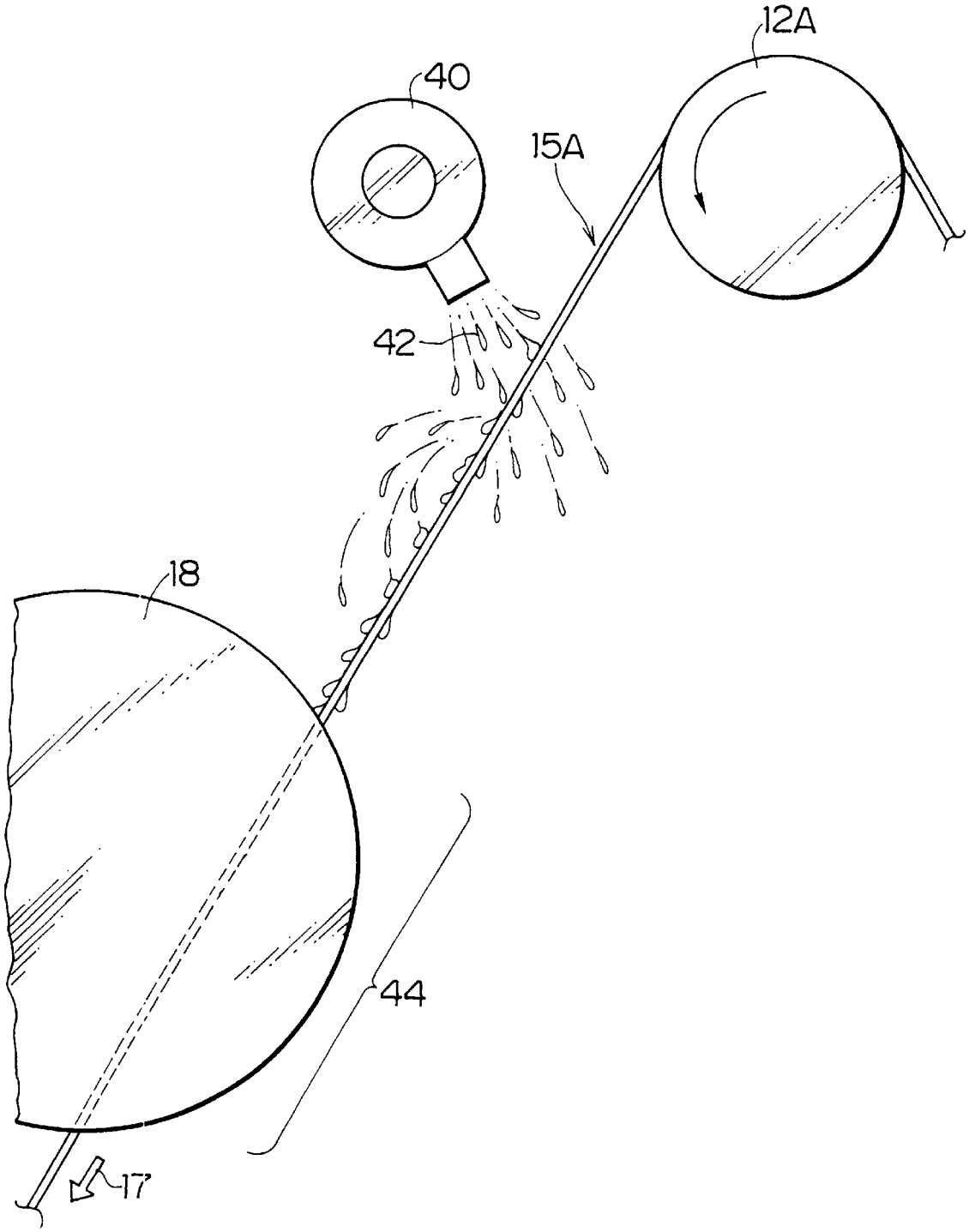
FIG. 6 is a partially enlarged view of the wire saw apparatus shown in FIG. 5.

FIG. 5 is a view of assistance in explaining the fourth embodiment of the wire saw apparatus 10 according to the present invention, and FIG. 6 is a partially enlarged view of FIG. 5, explaining the state where the processing liquid 42 is supplied to the wire line 15A. Parts similar to those in the first embodiment shown in FIGS. 1 and 2 are denoted by the same reference numerals.

The fourth embodiment is different from the first embodiment in that the grooved rollers 12A, 12B, 12C are arranged so that the wire line 15A between the grooved rollers 12A and 12B can move down diagonally. If the wire line 15A is moved down vertically, the processing liquid 42, which is supplied to the wire line 15A from the grind liquid supply nozzle 40 and is repelled by the wire line 15A, could not be adhered to the wire line 15A. To the contrary, in the wire saw apparatus 10 of the fourth embodiment, as shown in FIG. 6, the processing liquid 42, which is supplied to the wire line 15A from the grind liquid supply nozzle 40, falls onto the wire line 15A even if the processing liquid was once repelled by the wire line 15A. Thus, the processing liquid 42 can be satisfactorily adhered to the wire line 15A, and the processing liquid 42 can be effectively supplied to the cut portion 44 of the semiconductor ingot 18.

Figure 7:
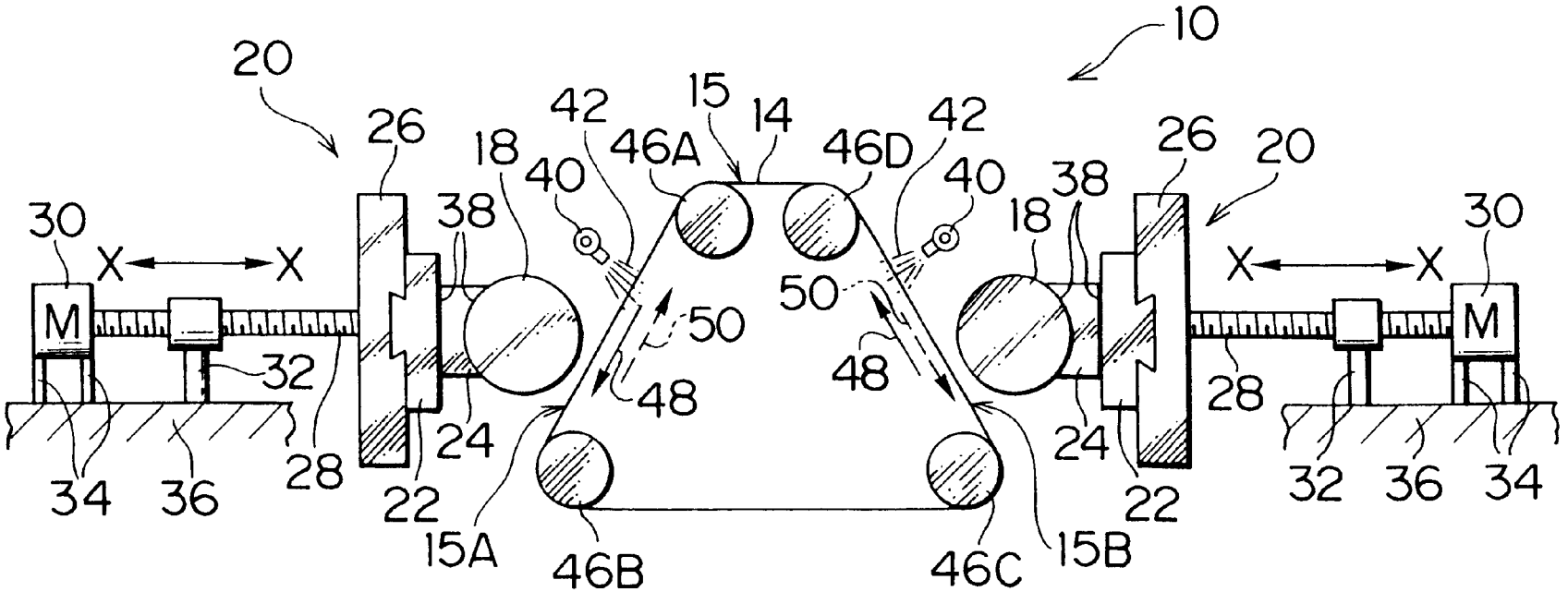
FIG. 7 is a view explaining a fifth embodiment of a wire saw apparatus according to the present invention.

FIG. 7 is a view of assistance in explaining the fifth embodiment of the wire saw apparatus 10 according to the present invention. Parts similar to those in the second embodiment shown in FIG. 3 are denoted by the same reference numerals.

The fifth embodiment is different from the second embodiment in that grooved rollers 46A, 46B, 46C, 46D are arranged in the form of an isosceles trapezoid as shown in FIG. 7 so that the wire line 15A between the grooved rollers 46A and 46B and the wire line 15B between the grooved rollers 46D and 46C can move down diagonally. Thus, as is the case in the previously-described fourth embodiment, the processing liquid 42, which is supplied to the wire line 15A or 15B from the grind liquid supply nozzle 40 and is once repelled by the wire line 15A or 15B, falls onto the wire line 15A or 15B again. Thereby, the processing liquid 42 can be supplied more effectively.

Figure 8:
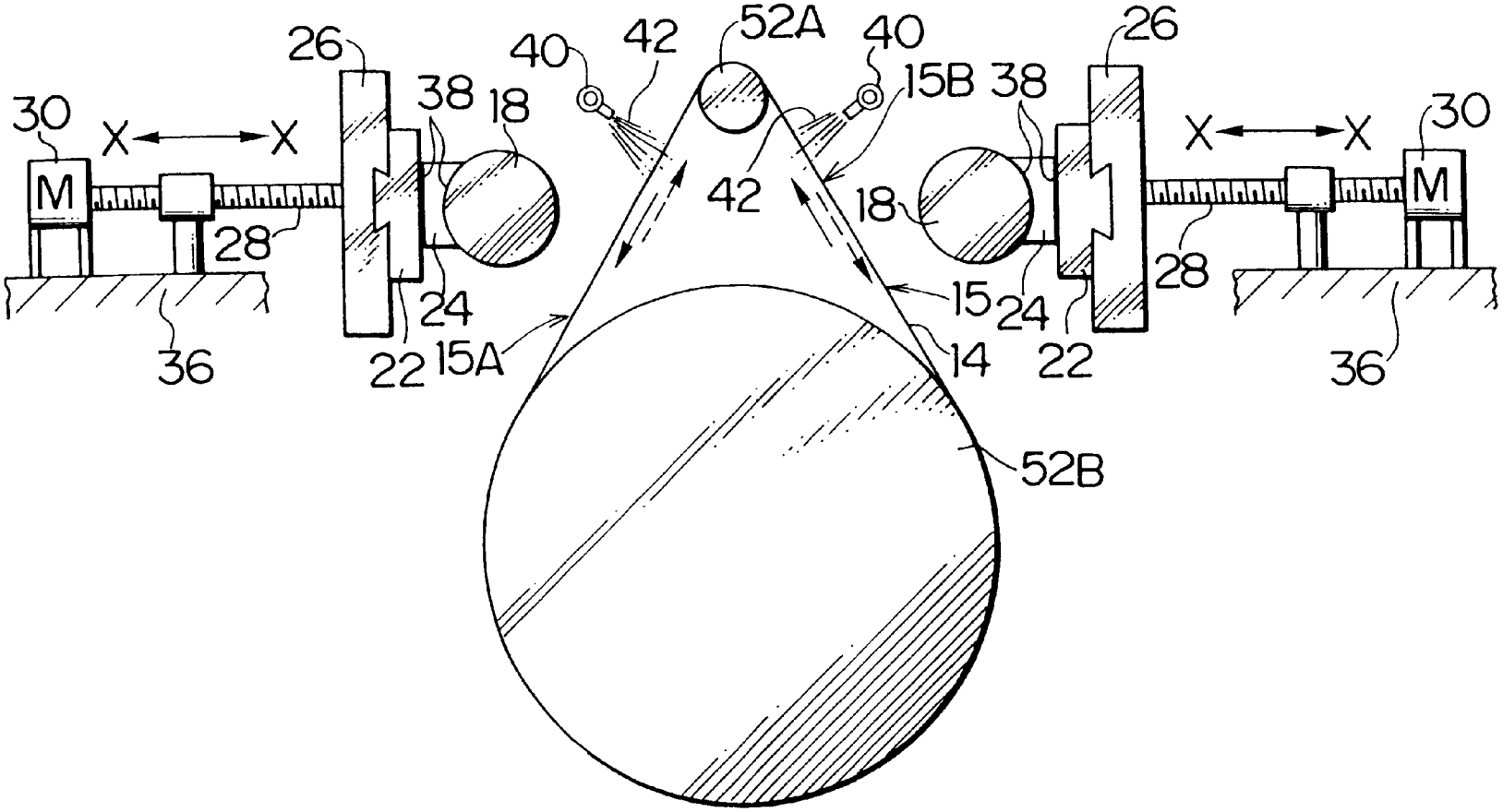
FIG. 8 is a view explaining a sixth embodiment of a wire saw apparatus according to the present invention.

FIG. 8 is a view of assistance in explaining the sixth embodiment of the wire saw apparatus 10 according to the present invention. Parts similar to those in the third embodiment in FIG. 4 are denoted by the same reference numerals.

The sixth embodiment is different from the third embodiment in that the diameter of the grooved roller 52B is larger than that of the grooved roller 52A so that the wire lines 15A, 15B between the grooved rollers 52A, 52B can move down diagonally. Thus, as is the case in the previously-described fourth embodiment, the processing liquid 42, which is supplied to the wire line 15A or 15B from the grind liquid supply nozzle 40 and is once repelled by the wire line 15A or 15B, falls onto the wire line 15A or 15B again. Thereby, the processing liquid 42 can be supplied more effectively.

In these embodiments, the semiconductor ingot is used as a workpiece for the explanation, however, the present invention should not be limited to this, the present invention can be applied to cut another hard-brittleness material such as a magnetic material and a ceramic. And the cases have been described in that the number of the rollers is two, three or four, however, the present invention should not be limited to this, in short, a moving portion, which moves in the vertical-downward direction, must be formed in the wire line.

As described above, according to the wafer cut method with a wire saw apparatus and the apparatus thereof in the present invention, the moving direction of the wire line in the cut portion of the workpiece is set to the vertical-downward direction to correspond to the gravity direction, and the processing liquid is supplied to the wire line from the upper side of the cut portion, therefore, the processing liquid supplied to the wire line flows along the wire line 15A and is supplied to the cut portion surely.

With this arrangement, the lapping is performed effectively with the grind grains, so that the cut performance can be improved. Therefore, the feed speed of the ingot can be increased, so that the cut time can be reduced. Further, the processing liquid is supplied to over all the cut portion of the workpiece evenly, so that the cut accuracy can be improved. Therefore, the flatness of the cut surface of the workpiece which has been cut becomes better, so that the quality of the wafer can be improved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wire saw apparatus, comprising:

two wire lines, each wire line being formed by winding a wire around rollers with a plurality of grooves, in which a workpiece is pressed against an inclined portion of the wire line to be cut into a plurality of wafers;

ingot cut-feed means for pushing a longitudinal direction of said workpiece perpendicular to the inclined portion of said wire line which moves; and grind liquid supply means placed at an upper side of a cut portion of said workpiece for supplying a processing liquid which includes grind grains to the inclined portion of said wire line;

wherein the two wire lines, which move in the diagonally downward direction by reciprocating said wire wound around four rollers with grooves arranged to form an isosceles trapezoid, are formed at right and left sides, and said ingot cut-feed means and said grind liquid supply means are provided at the right and left sides respectively.

2. A wire saw apparatus, comprising:

two wire lines, each wire line being formed by winding a wire around rollers with a plurality of grooves, in which a workpiece is pressed against an inclined portion of the wire line to be cut into a plurality of wafers;

ingot cut-feed means for pushing a longitudinal direction of said workpiece perpendicular to the inclined portion of said wire line which moves; and grind liquid supply means placed at an upper side of a cut portion of said workpiece for supplying a processing liquid which includes grind grains to the inclined portion of said wire line;

wherein the two wire lines, which move in the diagonally downward direction by reciprocating said wire wound around two upper and lower rollers with grooves, are formed at right and left sides, an external diameter of said lower roller is larger than that of said upper roller, and said ingot cut-feed means and said grind liquid supply means are provided at the right and left sides respectively.

3. A wire saw apparatus as set forth in claim 2, wherein said external diameters of said rollers with grooves are larger than that of said workpiece.

4. The wire saw apparatus as set forth in claim 1, wherein the grind liquid supply means includes a spray nozzle positioned above the workpiece and adjacent the wire line, the spray nozzle spraying the grind liquid onto the inclined portion of said wire line.

5. The wire saw apparatus as set forth in claim 7, wherein the ingot cut-feed means moves the workpiece along an axis that intersects the wire line, an angle formed by the axis of movement of the workpiece and a portion of the wire line extending upwardly from the cut portion being greater than 90°.

* * * * *